US009601823B2

(12) United States Patent
Konanur et al.

(10) Patent No.: US 9,601,823 B2
(45) Date of Patent: Mar. 21, 2017

(54) MOBILE DEVICE HOUSING INCLUDING AT LEAST ONE ANTENNA

(71) Applicant: INTEL CORPORATION, Santa Clara, CA (US)

(72) Inventors: Anand Konanur, Sunnyvale, CA (US); Ulun Karacaoglu, San Diego, CA (US); Songnan Yang, San Jose, CA (US); Shawn McEuen, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/092,886

(22) Filed: Apr. 7, 2016

(65) Prior Publication Data

US 2016/0218417 A1 Jul. 28, 2016

Related U.S. Application Data

(63) Continuation of application No. 14/871,532, filed on Sep. 30, 2015, which is a continuation of application No. 14/280,796, filed on May 19, 2014, now Pat. No. 9,160,061, which is a continuation of application No. 13/076,990, filed on Mar. 31, 2011, now Pat. No. 8,760,349.

(60) Provisional application No. 61/417,292, filed on Nov. 26, 2010.

(51) Int. Cl.

| | |
|---|---|
| ***H01Q 1/24*** | (2006.01) |
| ***H01Q 1/22*** | (2006.01) |
| ***H01Q 1/40*** | (2006.01) |
| ***H01Q 21/28*** | (2006.01) |

(52) U.S. Cl.
CPC ..... *H01Q 1/243* (2013.01); *H01Q 1/2266* (2013.01); *H01Q 1/40* (2013.01); *H01Q 21/28* (2013.01)

(58) Field of Classification Search
USPC ..... 343/712, 700, 745, 873
See application file for complete search history.

(56) References Cited

U.S. PATENT DOCUMENTS

| | | | |
|---|---|---|---|
| 8,760,349 | B2 | 6/2014 | Konanur et al. |
| 9,160,061 | B2 | 10/2015 | Konanur et al. |
| 2004/0164909 | A1 | 8/2004 | Yokochi et al. |
| 2007/0128940 | A1 | 6/2007 | Ho et al. |
| 2008/0036668 | A1 | 2/2008 | White et al. |
| 2008/0094290 | A1 | 4/2008 | Wen et al. |
| 2008/0227501 | A1 | 9/2008 | Joo et al. |
| 2009/0009415 | A1 | 1/2009 | Tanska et al. |
| 2010/0201582 | A1* | 8/2010 | Nam ..... B29C 45/14639 343/702 |

(Continued)

FOREIGN PATENT DOCUMENTS

KR 1020080100699 A 11/2008

OTHER PUBLICATIONS

International Search Report and Written Opinion for PCT Patent Application No. PCT/US2011/060228, mailed on Mar. 12, 2012, 9 pages.

(Continued)

*Primary Examiner* — Allyson Trail
(74) *Attorney, Agent, or Firm* — Shichrur & Co.

(57) ABSTRACT

Embodiments of systems and methods for providing in-mold laminate antennas are generally described herein. Other embodiments may be described and claimed.

14 Claims, 5 Drawing Sheets

(56) References Cited

U.S. PATENT DOCUMENTS

| | | | | |
|---|---|---|---|---|
| 2010/0271270 | A1* | 10/2010 | Sung | B29C 45/14065 343/702 |
| 2011/0025566 | A1 | 2/2011 | Suh et al. | |
| 2011/0032157 | A1 | 2/2011 | Suh et al. | |
| 2011/0122027 | A1* | 5/2011 | Wong | H01Q 1/243 343/700 MS |
| 2012/0076184 | A1* | 3/2012 | Tran | H01Q 1/085 375/222 |
| 2012/0206303 | A1 | 8/2012 | Desclos et al. | |
| 2012/0293120 | A1* | 11/2012 | Jang | H01Q 1/2225 320/108 |
| 2016/0093942 | A1 | 3/2016 | Konanur et al. | |

OTHER PUBLICATIONS

International Preliminary Report on Patentability for PCT/US2011/060228, mailed on Jun. 6, 2013; 6 pages.

Office Action for U.S. Appl. No. 13/076,990, mailed on Nov. 4, 2013, 18 pages.

Notice of Allowance for U.S. Appl. No. 13/076,990, mailed on Feb. 12, 2014, 8 pages.

Office Action for U.S. Appl. No. 14/280,796, mailed on Aug. 15, 2014, 6 pages.

Final Office Action for U.S. Appl. No. 14/280,796, mailed on Mar. 11, 2015, 12 pages.

Notice of Allowance for U.S. Appl. No. 14/280,796, mailed on Jun. 12, 2015, 12 pages.

Advisory Action for U.S. Appl. No. 14/280,796, mailed on Jun. 3, 2015, 3 pages.

Office Action for U.S. Appl. No. 14/871,532, mailed on Jan. 20, 2014, 6 pages.

Office Action for U.S. Appl. No. 14/871,532, mailed on Jul. 8, 2016, 14 pages.

Notice of Allowance for U.S. Appl. No. 14/871,532, mailed on Dec. 12, 2016, 12 pages.

* cited by examiner

MOBILE DEVICE HOUSING INCLUDING AT LEAST ONE ANTENNA

REFERENCE TO RELATED INVENTIONS

The present non-provisional application claims priority to U.S. Provisional Patent Application No. 61/417,292 filed Nov. 26, 2010, entitled "Apparatus System and a Method of Utilizing a Portion of a Mobile Platform as an Antenna."

FIELD OF THE INVENTION

This application relates to wireless systems and, more particularly, to systems and methods for embedding a number of antennas in a wireless platform.

BACKGROUND

Technological developments permit digitization and compression of large amounts of voice, video, imaging, and data information. The need to transfer data between platforms in wireless radio communication can require transmission of a number of data streams using a number of antennas. Each of the data streams can require one or more separate antennas within the wireless platform. It would be advantageous to provide an approach for incorporating the antennas in a manner that reduces a form factor of the wireless platform.

BRIEF DESCRIPTION OF THE DRAWINGS

The present invention is illustrated by way of example and not as a limitation in the figures of the accompanying drawings, in which.

DETAILED DESCRIPTION

In the following detailed description, numerous specific details are set forth in order to provide a thorough understanding of embodiments of the invention. However it will be understood by those skilled in the art that embodiments of the invention may be practiced without these specific details. In other instances, well-known methods, procedures, components and circuits have not been described in detail so as not to obscure embodiments of the invention.

It would be an advance in the art to provide a system and methods for incorporating a number of antenna elements or antennas in a wireless platform in a space efficient manner, thereby enabling smaller form factors for the wireless platforms. Antennas located in contemporary wireless devices typically occupy one or more spaces within the wireless device, wherein the spaces are typically added to the overall system design and created by increasing an overall size of the wireless device. However, increasing the overall size of the wireless platform, such as by adding space around the periphery of the display which is sometimes referred to as a bezel, constrains an amount of space made available for other elements in the wireless platform such as the display, battery, and processor.

Support for particular frequency bands such as those supporting a wireless wide area network (WWAN), digital television (DTV), and Long Term Evolution (LTE) requires separation from metallic objects, such as a display frame, to achieve a required bandwidth. In-mold laminate, which may also referred to as in-mold decoration or film insert molding, antennas systems may be used to incorporate multiple and various types of antennas in a wireless platform having necessary separation while reducing an amount of space needed to house the antennas. In-mold placement of the antennas can be used to reduce an overall size of a wireless platform and provide an improved form factor of the wireless platform, thereby providing additional space for other elements in the wireless platform.

Figure 1:
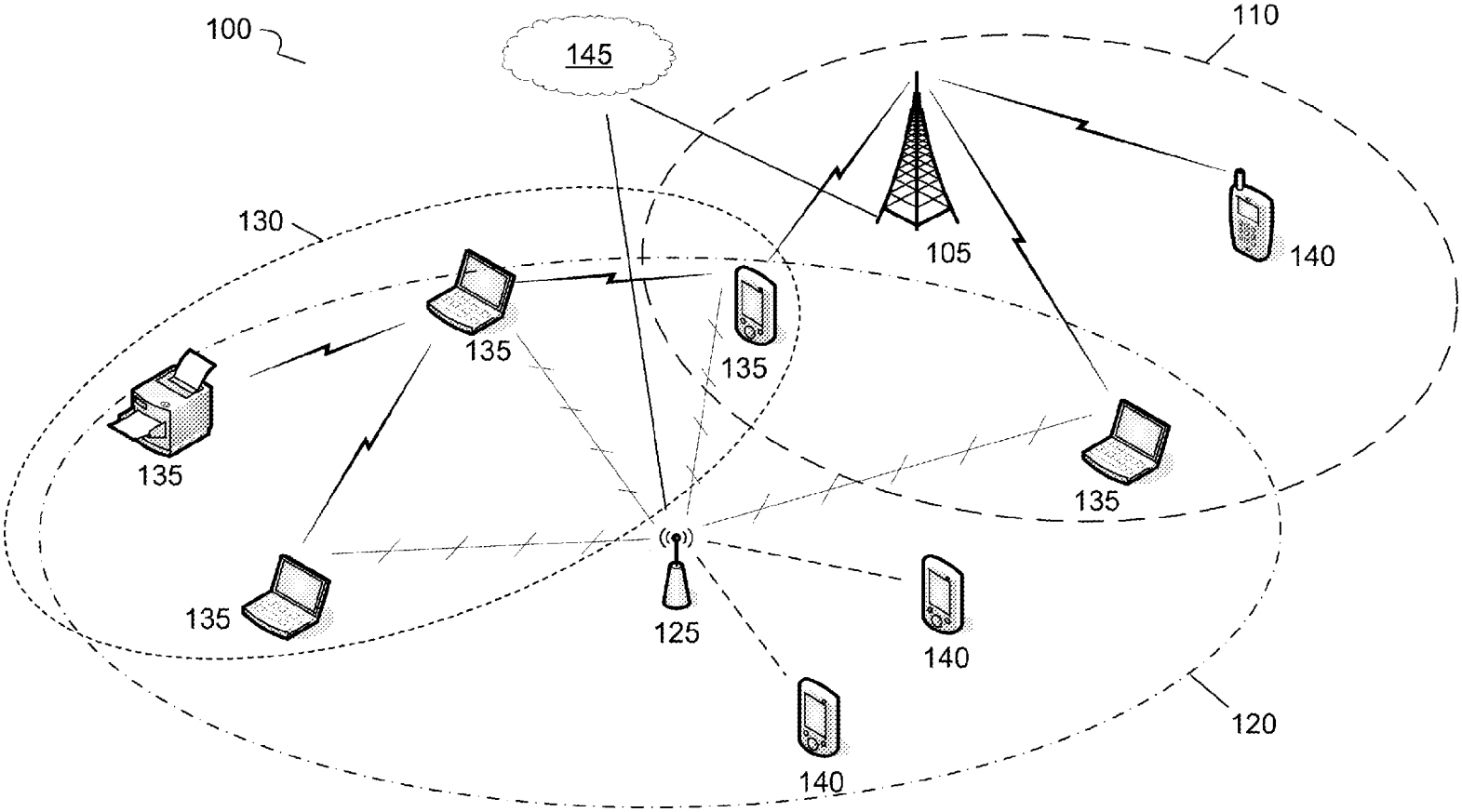
FIG. 1 is an illustration a wireless communication system, in accordance with some demonstrative embodiments.

Now turning to the figures, FIG. 1 illustrates a wireless communication system 100 in accordance with some embodiments of the invention. The wireless communication system 100 may include one or more wireless networks, generally shown as 110, 120, and 130. In particular, the wireless communication system 100 may include a WWAN 110, a WLAN 120, and a WPAN 130. Although FIG. 1 depicts three wireless networks, the wireless communication system 100 may include additional or fewer wireless communication networks including multiple overlapping networks of the same type. For example, the wireless communication system 100 may include one or more WMANs (not shown), broadcast or multicast television networks, additional WLANs, and/or WWANs. The methods and apparatus described herein are not limited in this regard.

The wireless communication system 100 also includes one or more platforms generally shown as multi-radio platforms 135 capable of accessing a plurality of wireless networks, and single-radio platforms 140 capable of accessing a single wireless network. For example, the platforms 135 and 140 may include wireless electronic devices such as a smartphone, a laptop computer, a handheld computer, a tablet computer, a cellular telephone, a mobile device, an audio and/or video player (e.g., an MP3 player or a DVD player), a gaming device, a video camera, a digital camera, a navigation device (e.g., a GPS device), a wireless peripheral (e.g., a printer, a scanner, a headset, a keyboard, a mouse, etc.), a medical device (e.g., a heart rate monitor, a blood pressure monitor, etc.), and/or other suitable fixed, portable, or mobile electronic devices. Although FIG. 1 depicts a number of platforms, the wireless communication system 100 may include more or less platforms 135 and 140.

Reference to a platform may be a user equipment (UE), subscriber station (SS), station (STA), mobile station (MS), advanced mobile station (AMS), high throughput (HT) station (STA), or very HT STA (VHT STA). The various forms of devices such as the platform, UE, SS, MS, HT STA, and VHT STA may be interchanged and reference to a particular device does not preclude other devices from being substituted in various embodiment(s). The platform can further communicate in the wireless communication system 100 with one or more other platforms described above and/or with other platforms such as a base station (BS), access point (AP), node, node B, or enhanced node B (eNode-B). Further, these terms may be conceptually interchanged, depending on which wireless protocol is being used in a particular wireless network, so a reference to BS herein may also be seen as a reference to either of ABS, eNode-B, or AP as one example.

The platforms 135 and 140 may use a variety of modulation techniques such as spread spectrum modulation (e.g., direct sequence code division multiple access (DS-CDMA) and/or frequency hopping code division multiple access (FH-CDMA)), time-division multiplexing (TDM) modulation, frequency-division multiplexing (FDM) modulation, orthogonal frequency-division multiplexing (OFDM) modulation, orthogonal frequency-division multiple access (OFDMA), single carrier frequency division multiple access (SC-FDMA), multi-carrier modulation (MDM), and/or other suitable modulation techniques to communicate via wireless links.

Although some of the above examples are described above with respect to standards developed by IEEE, the methods and apparatus disclosed herein are readily applicable to many specifications and/or standards developed by other special interest groups and/or standard development organizations (e.g., Wireless Fidelity (Wi-Fi) Alliance, Worldwide Interoperability for Microwave Access (WiMAX) Forum, Infrared Data Association (IrDA), Third Generation Partnership Project (3GPP), etc.). In some embodiments, communications may be in accordance with specific communication standards, such as the Institute of Electrical and Electronics Engineers (IEEE) standards including IEEE 802.11(a), 802.11(b), 802.11(g), 802.11(h) and/or 802.11(n) standards and/or proposed specifications for WLANs, although the scope of the invention is not limited in this respect as they may also be suitable to transmit and/or receive communications in accordance with other techniques and standards.

The platforms may operate in accordance with other wireless communication protocols to support the WWAN 110. In particular, these wireless communication protocols may be based on analog, digital, and/or dual-mode communication system technologies such as a Third Generation Partnership Project (3GPP), Global System for Mobile Communications (GSM) technology, Wideband Code Division Multiple Access (WCDMA) technology, General Packet Radio Services (GPRS) technology, Enhanced Data GSM Environment (EDGE) technology, Universal Mobile Telecommunications System (UMTS) technology, Long Term Evolution (LTE) standards based on these technologies, variations and evolutions of these standards, and/or other suitable wireless communication standards.

The terms "television signal(s)" or "digital television signals" in a television network as used herein in the wireless communication system include, for example, signals carrying television information, signals carrying audio/video information, Digital Television (DTV) signals, digital broadcast signals, Digital Terrestrial Television (DTTV) signals, signals in accordance with one or more Advanced Television Systems Committee (ATSC) standards, Vestigial SideBand (VSB) digital television signals (e.g., 8-VSB signals), Coded ODFM (COFDM) television signals, Digital Video Broadcasting-Terrestrial (DVB-T) signals, DVB-T2 signals, Integrated Services Digital Broadcasting (ISDB) signals, digital television signals carrying MPEG-2 audio/video, digital television signals carrying MPEG-4 audio/video or H.264 audio/video or MPEG-4 part 10 audio/video or MPEG-4 Advanced Video Coding (AVC) audio/video, Digital Multimedia Broadcasting (DMB) signals, DMB-Handheld (DMB-H) signals, High Definition Television (HDTV) signals, progressive scan digital television signals (e.g., 720p), interlaced digital televisions signals (e.g., 1080i), television signals transferred or received through a satellite or a dish, television signals transferred or received through the atmosphere or through cables, signals that include (in whole or in part) non-television data (e.g., radio and/or data services) in addition to or instead of digital television data, or the like.

Among the television signals that may be utilized for video is the Chinese digital television standard. The standard is designated number GB20600-2006 of the SAC (Standardization Administration of China), and is entitled "Framing Structure, Channel Coding and Modulation for Digital Television Terrestrial Broadcasting System", issued Aug. 18, 2006. The standard may also be referred to as DMB-T (Digital Multimedia Broadcasting-Terrestrial) or DMB-T/H (Digital Multimedia Broadcasting Terrestrial/Handheld). This standard will generally be referred to herein as "DMB-T".

In some embodiments, the wireless platforms operate as part of a peer-to-peer (P2P) network or as a hub, wherein a platform serves as a hub to access a first wireless network through a second wireless network. In other embodiments the platforms operate as part of a mesh network, in which communications may include packets routed on behalf of other wireless devices of the mesh network. Fixed wireless access, wireless local area networks, wireless personal area networks, portable multimedia streaming, and localized networks such as an in-vehicle networks, are some examples of applicable P2P and mesh networks.

Figure 2:
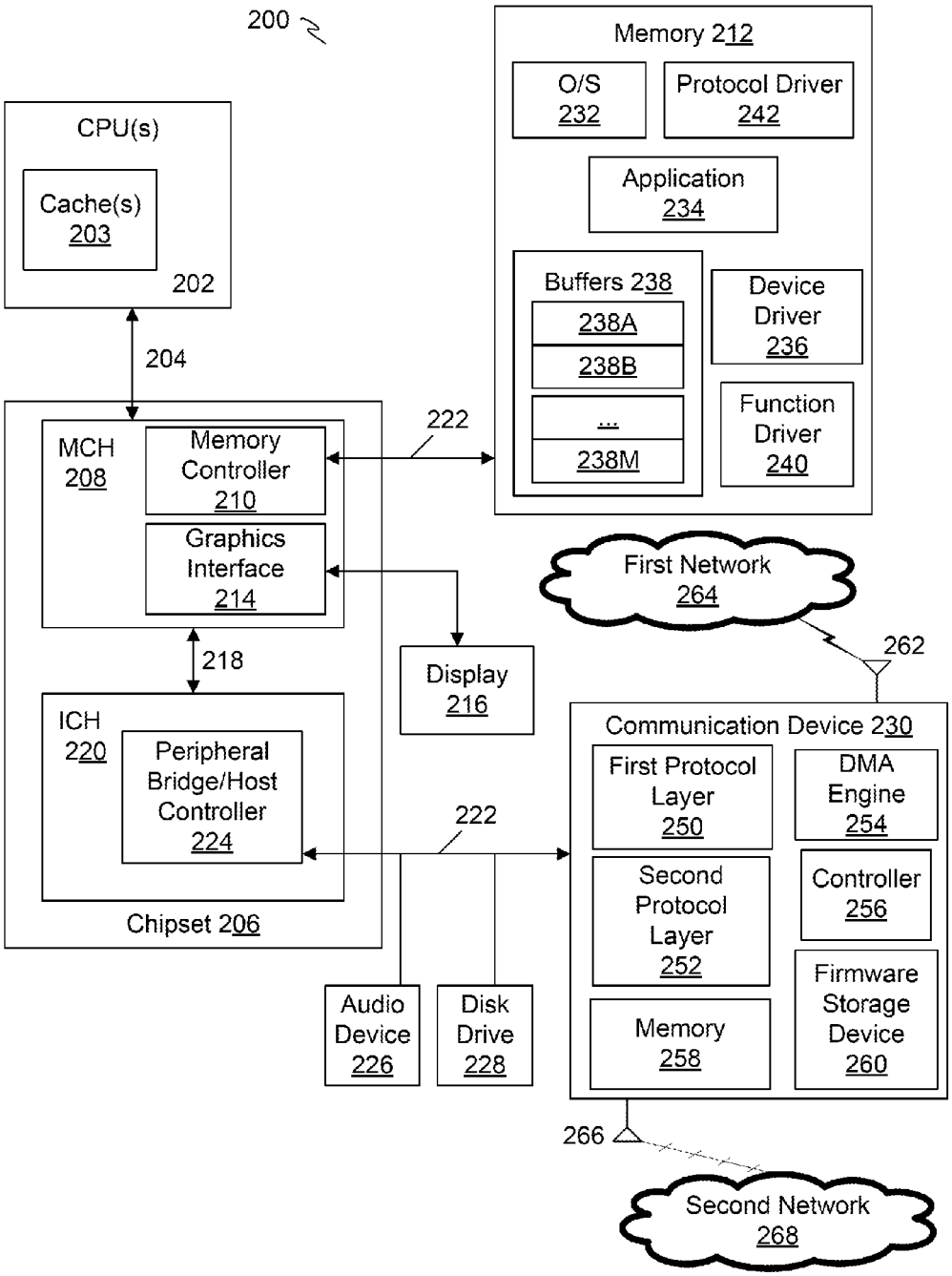
FIG. 2 is an illustration of a wireless platform, in accordance with some demonstrative embodiments.

FIG. 2 illustrates a block diagram of a wireless platform 200, which may be the multi-radio platform 135 of FIG. 1, in accordance with various embodiments. The wireless platform 200 may include one or more host processors or central processing unit(s) (CPUs) 202 (which may be collectively referred to herein as "processors 202" or more generally "processor 202") coupled to an interconnection network or bus 204. The processor 202 may include one or more caches 203, which may be private and/or shared in various embodiments. A chipset 206 may additionally be coupled to the interconnection network 204. The chipset 206 may include a memory control hub (MCH) 208. The MCH 208 may include a memory controller 210 that is coupled to a memory 212. The memory 212 may store data, e.g., including sequences of instructions that are executed by the processor 202, or any other device in communication with components of the wireless platform 200.

The MCH 208 may further include a graphics interface 214 coupled to a display 216, e.g., via a graphics accelerator. As shown in FIG. 2, a hub interface 218 may couple the MCH 208 to an input/output control hub (ICH) 220. The ICH 220 may provide an interface to input/output (I/O) devices coupled to the wireless platform 200. The ICH 220 may be coupled to a bus 222 through a peripheral bridge or host controller 224, such as a peripheral component interconnect (PCI) bridge, a universal serial bus (USB) controller, etc. The controller 224 may provide a data path between the processor 202 and peripheral devices. Other types of topologies may be utilized. Also, multiple buses may be coupled to the ICH 220, for example, through multiple bridges or controllers. For example, the bus 222 may comply with the Universal Serial Bus Specification, Revision 1.1, Sep. 23, 1998, and/or Universal Serial Bus Specification, Revision 2.0, Apr. 27, 2000 (including subsequent amendments to either revision). Alternatively, the bus 222 may comprise other types and configurations of bus systems. Moreover, other peripherals coupled to the ICH 220 may include, in various embodiments, integrated drive electronics (IDE) or small computer system interface (SCSI) hard drive(s), USB port(s), a keyboard, a mouse, parallel port(s), serial port(s), floppy disk drive(s), digital output support (e.g., digital video interface (DVI)), etc.

Additionally, the wireless platform 200 may include volatile and/or nonvolatile memory or storage. The memory 212 may include one or more of the following in various embodiments: an operating system (O/S) 232, application 234, device driver 236, buffers 238, function driver 240, and/or protocol driver 242. Programs and/or data stored in the memory 212 may be swapped into the solid state drive 228 as part of memory management operations. The processor(s) 302 executes various commands and processes one or more packets 246 with one or more computing devices coupled to a first network 264 and/or a second network 268 (such as the multi-radio platform 135 and/or single-radio platform 140 of FIG. 1). In various embodiments, a packet may be a sequence of one or more symbols and/or values that may be encoded by one or more electrical signals transmitted from at least one sender to at least one receiver (e.g., over a network such as the network 102). For example, each packet may have a header that includes information that may be utilized in routing and/or processing of the packet may comprise the continuity counter, a sync byte, source address, a destination address, packet type, etc. Each packet may also have a payload that includes the raw data or content the packet is transferring between various platforms.

In various embodiments, the application 234 may utilize the O/S 232 to communicate with various components of the wireless platform 200, e.g., through the device driver 236 and/or function driver 240. For example, the device driver 236 and function driver 240 may be used for different categories, e.g., device driver 236 may manage generic device class attributes, whereas the function driver 240 may manage device specific attributes (such as USB specific commands). In various embodiments, the device driver 236 may allocate one or more buffers to store packet data.

As illustrated in FIG. 2, the communication device 230 includes a first network protocol layer 250 and a second network protocol layer 252 for implementing the physical communication layer to send and receive network packets to and from the base station 105, the access point 125, and/or other wireless platform(s) 200 (e.g. multi-radio station 135, single-radio station 140) over a first radio 262 and/or a second radio 266 each having a number of antennas. The communication device 230 may further include a direct memory access (DMA) engine 252, which may write packet data to buffers 238 to transmit and/or receive data. Additionally, the communication device 230 may include a controller 254, which may include logic, such as a programmable processor for example, to perform communication device related operations. In various embodiments, the controller 254 may be a MAC (media access control) component. The communication device 230 may further include a memory 256, such as any type of volatile/nonvolatile memory (e.g., including one or more cache(s) and/or other memory types discussed with reference to memory 212).

In various embodiments, the communication device 230 may include a firmware storage device 260 to store firmware (or software) that may be utilized in management of various functions performed by components of the communication device 230. Further, the wireless platform 200 may have a first radio 262 to communicate over a single network such as the single radio platform 140 of FIG. 1. Alternately, the wireless platform 200 may have two or more radios including additional protocol layer(s) to communicate over a plurality of networks such as the multi-radio platform 135 of FIG. 1. Further, the wireless platform 200 may also comprise elements to further communicate over one or more wired networks including an 802.3 network such as Ethernet or GigE (IEEE 802.3-2008) or future derivatives thereof.

Figure 3:
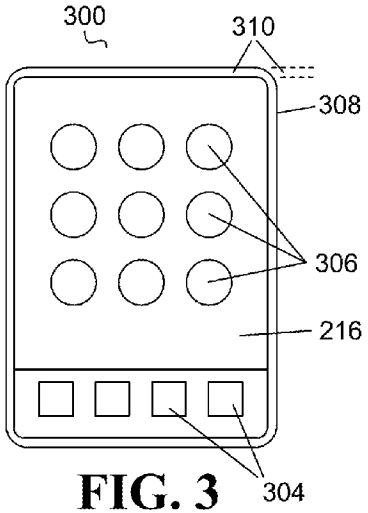
FIG. 3 is an illustration of a mobile device, in accordance with some demonstrative embodiments.

FIG. 3 is a block diagram of a mobile device 300, which may be a in accordance with some demonstrative embodiments. The mobile device 300 may be the wireless platform 200 in the form of a handheld computing device such as a tablet computer, a smartphone, cell-phone, a client, or other device capable of receiving and/or transmitting wireless communications. The mobile device 300 includes a man-machine interface such as a display 216 configured to provide display elements 306 and one or more inputs 304. The display 216 may incorporate the inputs 304 and display elements 306 through interactive touch-screen capability and/or the inputs 304 may be mechanically and/or audibly actuated, however the embodiment is not so limited. The mobile device 300 also comprises a cover 308 including a number of housings or shrouds to encase or otherwise secure components of the mobile device 300. A distance that exists substantially between an end of the display 216 and an end of the housing 308 is a bezel region 310, which extends a depth into the mobile device 300 to form a three dimensional space. In the embodiments of FIG. 3, the bezel region 310 is minimized or is substantially reduced to eliminate space between an end of the display 216, which may comprise a metal frame, and the end of the cover 308. In other embodiments, the end of the display 216 may define an end of the mobile device 300.

Figure 4:
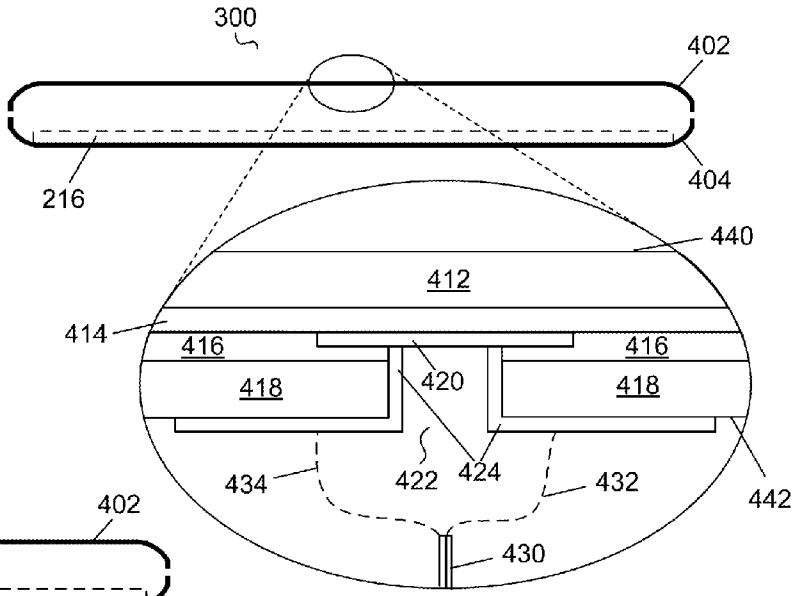
FIG. 4 is an illustration of an antenna embedded in the mobile device of FIG. 3, in accordance with some demonstrative embodiments.

FIG. 4 is a block diagram of an antenna embedded in the mobile device 300 of FIG. 3 with in-mold laminate antennas comprising laminate antenna structures, in accordance with some demonstrative embodiments. FIG. 4 illustrates the mobile device 300 from a side view with the display 216 oriented downward. The mobile device 300 comprises two covering elements, referred to as an upper housing 402 and a lower housing 404. A portion of the upper housing 402 having an exposed surface 440 is magnified to provide a cross-sectional view of the portion of the upper housing 402 comprising an upper layer 412, which may be a transparent, translucent, or opaque conductive or insulative layer on an exposed side of the upper housing 402. In one embodiment, the upper layer 412 is a film insert to provide protection for an underlying layer such as a intermediate layer 414, which may comprise cosmetic characteristics or a graphics image. In another embodiment, not shown, the outer layer 412 and the intermediate layer 414 is a single layer.

As shown in the magnified view, a conductive trace or antenna element 420 or radiating means is formed or positioned adjacent to the intermediate layer 414. The antenna element 420 may be a metal trace, formed using a physical vapor deposition process or a chemical vapor deposition process, or a conductive ink layer formed on the intermediate layer 414 and selectively designed to transmit and receive wireless signals. In another embodiment, the antenna element 420 is a conductive element that is positioned adjacent to the intermediate layer 414. An optional conformal layer 416 is formed adjacent to the antenna element 420 wherein the conformal layer 416 may be a substantially planar layer formed over or in-plane with the antenna element 420. A base layer 418 is positioned adjacent to the conformal layer 416, wherein the base layer 418 may be an elastomer, composite, or a plastic layer which may be injected molded.

A feedthrough or via 422 is formed or otherwise provided through the base layer 418 and the conformal layer 416 to provide access to the antenna element 420. A conductive channel such as via interconnects 424 are provided to connect the antenna element 420 to a non-exposed surface 442 of the upper housing 402 and to convey electromagnetic signals such as RF signals to and from the antenna element 420 to a radio such as the communication device 230. The non-exposed surface 442 is generally an inwardly facing surface that is positioned proximate to inner elements of the mobile platform 300. The exposed surface 440 is an outwardly facing surface of the mobile platform 300.

The via interconnects 424 comprise a conductive material such as copper (Cu), gold (Au), or another suitable conductive material and are routed through the base layer 418 to provide radio frequency (RF) signals or other electromagnetic signals through a dual channel conductor, such as a dual conductor cable or co-axial cable 430 having an inner conductor 432 and an outer conductor 434, to a radio element which may be the communication device 230 of FIG. 2. In an alternate embodiment, the channel is routed using shielded stripline or microstrip type transmission structures. A stripline is an electrical transmission line used to convey RF signals and is formed of a conductive material, for example one or more metals such as copper (Cu) or gold (Au), sandwiched between two ground elements such as ground planes. A microstrip is an alternate type of electrical transmission line. The microstrip is a conductive material formed on a dielectric layer that separates the microstrip from a ground element such as a ground plane.

Each antenna formed in the upper housing 402 of the embodiments shown in FIG. 4 and/or the lower housing 404 (not shown) may be configured to communicate over a particular frequency band based on particular applications or network protocol(s). Further, multiple antennas may be incorporated in the upper housing 402 and/or the lower housing 404 per frequency band to support multiple antenna inputs and/or outputs. Antenna types used comprise dipole, patch, slot planar, and loop style which may be used because of their low profile, low cost, light weight, and their ease of integration into planar arrays. Also, other types such as endfire, quasi-Yagi-Uda, planar slot, and other related antenna patterns may be used based on application requirements and system design.

Figure 5:
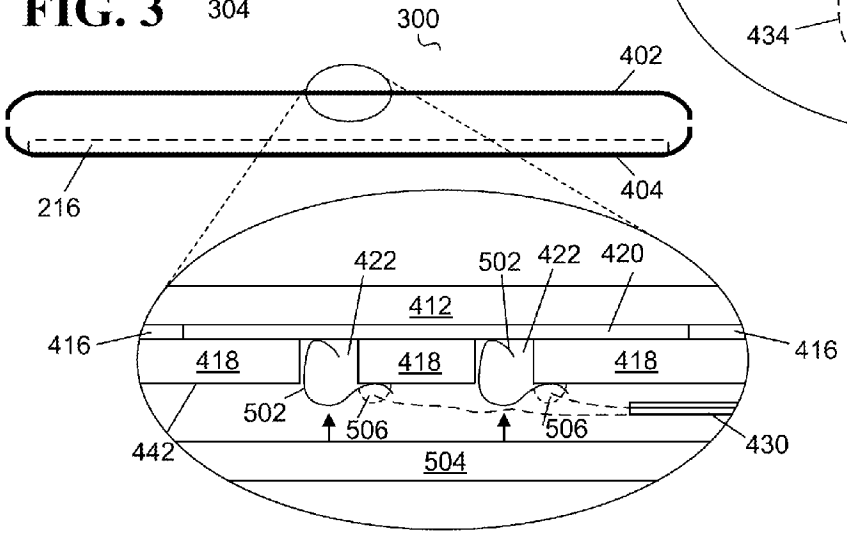
FIG. 5 is an illustration of an antenna embedded in the mobile device of FIG. 3, in accordance with some demonstrative embodiments.

FIG. 5 is a block diagram of a mobile platform with in-mold laminate antennas, in accordance with some demonstrative embodiments. FIG. 5 illustrates alternate embodiments of the mobile device 300 of FIG. 4. In FIG. 5, the antenna element 420 is positioned between the outer layer 412 and the substrate layer 418 with vias 422 formed to provide access to the antenna element 420 from the non-exposed surface 442. In this embodiment, spring interconnects 502 are positioned against the antenna element 420 to provide a channel to convey electromagnetic signals such as RF signals to and from the antenna element 420 to a radio such as the communication device 230. The spring interconnects 502 are directed against the antenna element 420 through placement of an inner element 504 of the mobile platform 300. For example, during assembly of the mobile platform 300, the inner element which may be a portion of a circuit board, a battery, or another element within the mobile platform 300 that is pressed against the spring interconnects 502. Pressure from the inner element(s) force the spring interconnects against the antenna element 420 to form a conductive pathway from the antenna element 420 to a current carrying device such as a solder ball 506. The solder ball 506 also connects to another channel to a signal carrying channel such as the co-axial cable 430.

Figure 6:
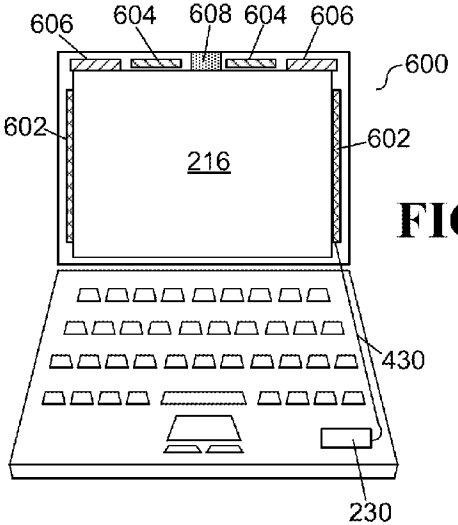
FIG. 6 is an illustration of a portable device, in accordance with some demonstrative embodiments.

Now turning to FIG. 6, which is a block diagram of a notebook device 600 which may be the wireless platform 200 of FIG. 2 having in-mold laminate antennas in accordance with some demonstrative embodiments. The notebook device 600 comprises the communication device 230 of FIG. 2 and a co-axial cable 430 for coupling the communication device 230 to a first network antenna 602. Second network antennas 604, third network antennas 606, and fourth network antennas 608 are also positioned in the notebook device 600 for communication over a plurality of networks. In embodiments, the first network antennas 602 may be configured to communicate over one or more DTV protocols, the second network antennas 604 may be configured to communicate over one or more WLAN protocols, the third network antennas 606 may be configured to communicate over one or more WWAN protocols, and the fourth network antenna 608 may be configured to communicate over one or more VHF protocols. For example, each antenna may be configured to operate over a single network protocol or more than one antenna may be configured to operate over a single network protocol. In a further example, a plurality of antennas may be configured to operate over a single network as multiple arms of an antenna type, such as a dipole antenna, as indicated by the fourth network antenna 608 wherein additional elements such as a chip balun (not shown) may be used to provide a balanced signal feed.

Figure 7:
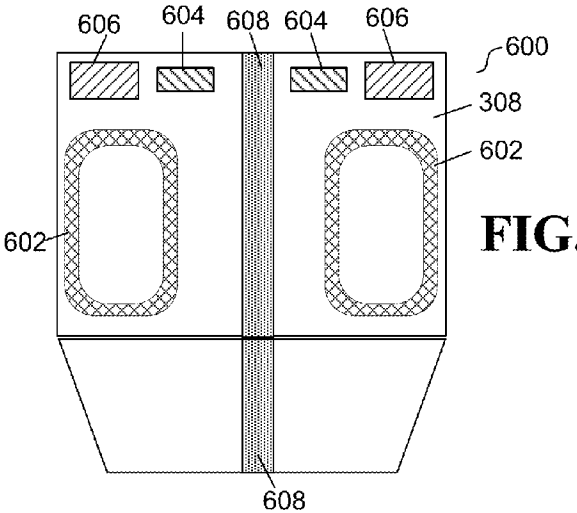
FIG. 7 is an illustration of an antenna embedded in the portable device of FIG. 6, in accordance with some demonstrative embodiments.

FIG. 7 is a block diagram of an antenna embedded in the notebook device of FIG. 6, in accordance with some demonstrative embodiments. In FIG. 7, the notebook device 600 is illustrated from a rear view to indicate one embodiment for placement of the antennas (e.g. 602, 604, 606, and 608) along a cover 308 of the notebook device. However, the embodiment is not so limited and fewer or additional antennas and antenna types may be positioned on the notebook device 600. A portion of the notebook device 610 housing is illustrated in a side-view in FIG. 8 in accordance with some demonstrative embodiments comprising laminate antenna structures.

Figure 8:
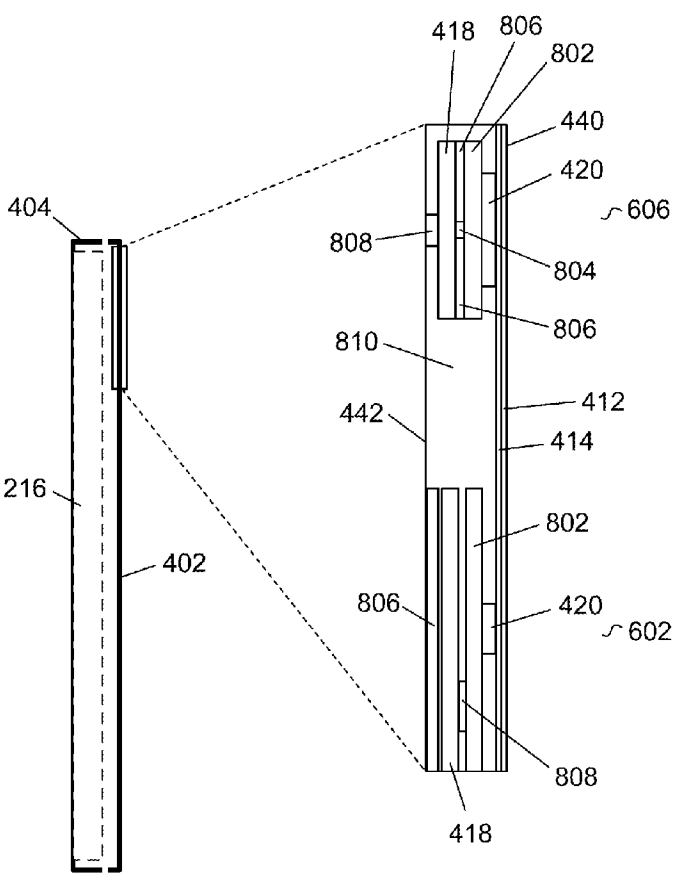
FIG. 8 is an illustration of an antenna embedded in the portable device of FIG. 6, in accordance with some demonstrative embodiments.

FIG. 8 illustrates elements of FIGS. 2 through 5 and placement of the first network antenna 602 and the third network antenna 606 behind the display 216 and in the upper housing 402 of the notebook device 610, wherein the upper housing 402 has an exposed surface 440 and a non-exposed surface 442. The upper housing 402 comprises an outer layer 412 and an optional intermediate layer 414 in one embodiment. An antenna element 420 of the first network antenna 602 is formed on or affixed to the outer layer 412 or optional intermediate layer 414 and a chassis 802 is positioned adjacent to the antenna element 420. The chassis 802 may be used to position the antenna element 420 relative to a microstrip 808. A substrate layer 418 is formed adjacent the microstrip 808 and a ground element 806 is formed adjacent the ground element 806. The non-exposed surface 442 of the upper housing 402 may be planar with the ground element 806, or an optional layer (not shown) may be formed or positioned adjacent the ground element 806 to provide an alternate non-exposed surface 442.

An antenna element 420 of the third network antenna 606 is formed on or affixed to the outer layer 412 or optional intermediate layer 414 and a chassis 802 is positioned adjacent to the antenna element 420. The chassis 802 may be used to position the antenna element 420 relative to ground elements 806 with a slot 804 or via 422 formed between the ground elements 806. A substrate layer 418 is formed or positioned adjacent the ground elements 806 and a microstrip 808 is formed or positioned adjacent the substrate layer 418. The non-exposed surface 442 of the upper housing 402 may be planar with the microstrip 808, or an optional layer (not shown) may be formed or positioned adjacent the microstrip 808 to provide an alternate non-exposed surface 442. A mold filler 810 may optionally be provided between the antenna elements and to provide a further substrate to mount the ground element 806 an/or the microstrip 808. As an alternate feed structure, the ground element and/or the microstrip 808 may be affixed, such as through a glue, adhesive, or other mechanical mount, to the mold filler 810. Further, a pathway may be formed along a surface of the mold filler 810, such as through a groove or other feature provided in the mold filler 810 to house or otherwise provide space for the ground element 806 an/or the microstrip 808.

Figure 9:
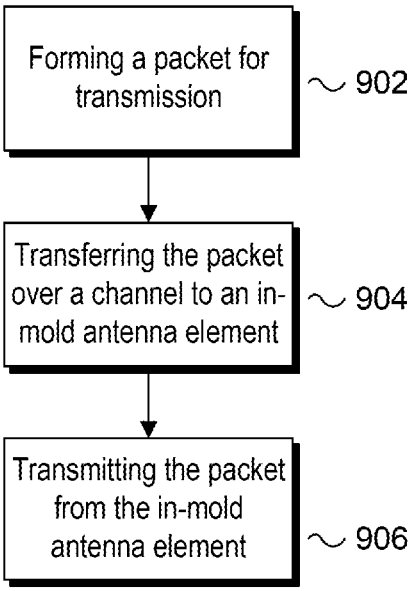
FIG. 9 is a block diagram of methods for implementing antennas in a wireless platform, in accordance with some demonstrative embodiments.

FIG. 9 is a block diagram illustration of methods for implementing in-mold laminate (IML), in-mold decoration (IMD), or film insert molding (FIM) antennas systems in a wireless platform 200, in accordance with some demonstrative embodiments as described earlier in reference to FIGS. 1 through 8. In element 902, a packet is formed by the wireless platform 200 for transmission in a wireless communication system 100. A signal comprising the packet is communicated from a communication device 230 over a channel in element 902, wherein the channel is a via interconnect or a spring interconnect 502, to an antenna element 420. The signal is radiated from the antenna element 420 to a receiver in a wireless communication system 100. In alternate embodiments, the antenna element 420 receives a signal in a wireless communications system 100 and transfers the signal through the channel to the communication device 230.

The term "device" or "platform" as used herein includes, for example, a platform capable of wireless communication, a communication device capable of wireless communication, a communication station capable of wireless communication, a portable or non-portable device capable of wireless communication, or the like. In some demonstrative embodiments, a wireless platform may be or may include a peripheral that is integrated with a computer, or a peripheral that is attached to a computer. In some demonstrative embodiments, the term "platform" may optionally include a wireless service. In addition, the term "plurality" as used throughout the specification describes two or more components, devices, elements, parameters and the like.

While certain features of the invention have been illustrated and described herein, many modifications, substitutions, changes, and equivalents will now occur to those skilled in the art. It is, therefore, to be understood that the appended claims are intended to cover all such modifications and changes as fall within embodiments of the invention.

What is claimed is:

1. A mobile device housing comprising:

a first layer having a first surface;

a second layer having a second surface, the second surface opposite to said first surface, the second layer comprising an inject molded layer;

at least one antenna element, at least a portion of the antenna element is in an internal area between the first and second surfaces; and at least one conductive connector having a first end connected to the portion of the antenna element within the internal area, and a second end exposed via the second surface to convey signals between the antenna element and a circuit of the mobile device.

2. The mobile device housing of claim 1, wherein the second layer comprises a molded plastic layer.

3. The mobile device housing of claim 1, wherein the first layer comprises a non-conductive layer.

4. The mobile device housing of claim 1, wherein an entirety of the antenna element is within the internal area between the first and second surfaces.

5. The mobile device housing of claim 1 comprising a plurality of conductive connectors, each of the conductive connectors having one end connected to the at least portion of the antenna element and another exposed end.

6. The mobile device housing of claim 1, wherein an outer surface of the housing comprises said first surface.

7. The mobile device housing of claim 1, wherein the at least one antenna element comprises a plurality of antenna elements.

8. A mobile device comprising:

at least one circuit to process wireless communication signals; and a housing comprising a first layer having a first surface, a second layer having a second surface, the second surface opposite to said first surface, the second layer comprising an inject molded layer, at least one antenna element, at least a portion of the antenna element is in an internal area between the first and second surfaces, and at least one conductive connector, the conductive connector having a first end connected to the portion of the antenna element within the internal area, and a second end exposed to the second surface to convey said wireless communication signals between the circuit and the antenna element.

9. The mobile device of claim 8, wherein the second layer comprises a molded plastic layer.

10. The mobile device of claim 8, wherein the first layer comprises a non-conductive layer.

11. The mobile device of claim 8, wherein an entirety of the antenna element is within the internal area between the first and second surfaces.

12. The mobile device of claim 8, wherein the housing comprises a plurality of conductive connectors, each of the conductive connectors having one end connected to the portion of the antenna element and another exposed end.

13. The mobile device of claim 8, wherein an outer surface of the housing comprises said first surface.

14. The mobile device of claim 8, wherein the at least one antenna element comprises a plurality of antenna elements.

* * * * *